US010330106B2

(12) United States Patent
Hossain et al.

(10) Patent No.: US 10,330,106 B2
(45) Date of Patent: Jun. 25, 2019

(54) CENTRIFUGAL COMPRESSOR WITH SURGE CONTROL

(71) Applicant: Daikin Applied Americas Inc., Minneapolis, MN (US)

(72) Inventors: Md Anwar Hossain, Maple Grove, MN (US); Nobuhiro Umeda, Plymouth, MN (US); Takatoshi Takigawa, St. Louis Park, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 509 days.

(21) Appl. No.: 14/873,671

(22) Filed: Oct. 2, 2015

(65) Prior Publication Data

US 2017/0097005 A1 Apr. 6, 2017

(51) Int. Cl.
*F25B 1/04* (2006.01)
*F04D 17/10* (2006.01)
(Continued)

(52) U.S. Cl.
CPC ..... *F04D 27/02* (2013.01); *F04D 17/10* (2013.01); *F04D 25/06* (2013.01); *F04D 27/004* (2013.01);
(Continued)

(58) Field of Classification Search
CPC ..... F04D 27/02; F04D 27/004; F04D 27/00; F04D 27/0246; F04D 27/0253;
(Continued)

(56) References Cited

U.S. PATENT DOCUMENTS 2,405,048 A * 7/1946 Nickerson ..... F04D 29/441 415/142
6,591,612 B2 * 7/2003 Bolz ..... F02B 33/40 123/565
(Continued)

FOREIGN PATENT DOCUMENTS

JP 5-263796 A 10/1993
JP 2009-281213 A 12/2009
(Continued)

OTHER PUBLICATIONS

The International Search Report for the corresponding international application No. PCT/US2016/054717, dated Jan. 18, 2017.
(Continued)

*Primary Examiner* — Richard A Edgar
(74) *Attorney, Agent, or Firm* — Global IP Counselors, LLP

(57) ABSTRACT

A centrifugal compressor for a chiller includes a casing, an inlet guide vane, an impeller downstream of the inlet guide vane, a motor and a diffuser. The casing has inlet and outlet portions with the inlet guide vane disposed in the inlet portion. The impeller is rotatable about a rotation axis defining an axial direction, and the impeller is adjustably mounted within the casing along the axial direction between at least a first flow rate position and a second flow rate position. The motor rotates the impeller. The diffuser is disposed in the outlet portion downstream from the impeller with a outlet port of the outlet portion being disposed between the impeller and the diffuser.

12 Claims, 6 Drawing Sheets

(51) Int. Cl.

| | |
|---|---|
| ***F04D 25/06*** | (2006.01) |
| ***F04D 27/00*** | (2006.01) |
| ***F04D 27/02*** | (2006.01) |
| ***F04D 29/05*** | (2006.01) |
| ***F04D 29/28*** | (2006.01) |
| ***F04D 29/42*** | (2006.01) |
| ***F04D 29/44*** | (2006.01) |
| ***F04D 29/052*** | (2006.01) |
| ***F04D 29/058*** | (2006.01) |

(52) U.S. Cl.
CPC ..... *F04D 27/0246* (2013.01); *F04D 29/05* (2013.01); *F04D 29/052* (2013.01); *F04D 29/058* (2013.01); *F04D 29/284* (2013.01); *F04D 29/4206* (2013.01); *F04D 29/444* (2013.01); *F25B 1/04* (2013.01)

(58) Field of Classification Search
CPC ..... F04D 27/0261; F04D 17/10; F04D 25/06; F04D 29/05; F04D 29/052; F04D 29/058; F04D 29/284; F04D 29/4206; F04D 29/444; F25B 1/04
See application file for complete search history.

(56) References Cited

U.S. PATENT DOCUMENTS

2013/0156544 A1* 6/2013 Sishtla ..... F04D 27/0261 415/1
2015/0010383 A1* 1/2015 Sun ..... F04D 27/0246 415/1

FOREIGN PATENT DOCUMENTS

| | | | |
|---|---|---|---|
| JP | 2014-231826 | A | 12/2014 |
| WO | 2009/056987 | A1 | 5/2009 |
| WO | 2013/012491 | A1 | 1/2013 |
| WO | 2013/015885 | A1 | 1/2013 |

OTHER PUBLICATIONS

Written Opinion and International Preliminary Report on Patentability for the corresponding international application No. PCT/US2016/054717, dated Apr. 3, 2018.

* cited by examiner

CENTRIFUGAL COMPRESSOR WITH SURGE CONTROL

BACKGROUND

Field of the Invention

The present invention generally relates to a centrifugal compressor. More specifically, the present invention relates to a centrifugal compressor with surge control.

Background Information

A chiller system is a refrigerating machine or apparatus that removes heat from a medium. Commonly a liquid such as water is used as the medium and the chiller system operates in a vapor-compression refrigeration cycle. This liquid can then be circulated through a heat exchanger to cool air or equipment as required. As a necessary byproduct, refrigeration creates waste heat that must be exhausted to ambient or, for greater efficiency, recovered for heating purposes. A conventional chiller system often utilizes a centrifugal compressor, which is often referred to as a turbo compressor. Thus, such chiller systems can be referred to as turbo chillers. Alternatively, other types of compressors, e.g. a screw compressor, can be utilized.

In a conventional (turbo) chiller, refrigerant is compressed in the centrifugal compressor and sent to a heat exchanger in which heat exchange occurs between the refrigerant and a heat exchange medium (liquid). This heat exchanger is referred to as a condenser because the refrigerant condenses in this heat exchanger. As a result, heat is transferred to the medium (liquid) so that the medium is heated. Refrigerant exiting the condenser is expanded by an expansion valve and sent to another heat exchanger in which heat exchange occurs between the refrigerant and a heat exchange medium (liquid). This heat exchanger is referred to as an evaporator because refrigerant is heated (evaporated) in this heat exchanger. As a result, heat is transferred from the medium (liquid) to the refrigerant, and the liquid is chilled. The refrigerant from the evaporator is then returned to the centrifugal compressor and the cycle is repeated. The liquid utilized is often water.

A conventional centrifugal compressor basically includes a casing, an inlet guide vane, an impeller, a diffuser, a motor, various sensors and a controller. Refrigerant flows in order through the inlet guide vane, the impeller and the diffuser. Thus, the inlet guide vane is coupled to a gas intake port of the centrifugal compressor while the diffuser is coupled to a gas outlet port of the impeller. The inlet guide vane controls the flow rate of refrigerant gas into the impeller. The impeller increases the velocity of refrigerant gas, generally without changing pressure. The diffuser increases the refrigerant pressure without changing the velocity. The motor rotates the impeller. The controller controls the motor, the inlet guide vane and the expansion valve. In this manner, the refrigerant is compressed in a conventional centrifugal compressor. The inlet guide vane is typically adjustable and the motor speed is typically adjustable to adjust the capacity of the system. In addition, the diffuser may be adjustable to further adjust the capacity of the system. The controller controls the motor, the inlet guide vane and the expansion valve. The controller can further control any additional controllable elements such as the diffuser.

When the pressure behind the compressor is higher than the compressor outlet pressure, the fluid tends to reverse or even flow back in the compressor. As a consequence, the pressure will decrease, inlet pressure will increase and the flow reverses again. This phenomenon, called surge, repeats and occurs in cycles. The compressor loses the ability to maintain the peak head when surge occurs and the entire system becomes unstable. A collection of surge points during varying compressor speed or varying inlet guide vane angle is called a surge line. In normal conditions, the compressor operates in the right side of the surge line. However, during startup/emergency shutdown, the operating point will move towards the surge line because flow is reduced. If conditions are such that the operating point approaches the surge line, flow recirculation occurs in the impeller and diffuser. The flow recirculation, which causes flow separation, will eventually cause a decrease in the discharge pressure, and flow from suction to discharge will resume. Surging can cause the compressor to overheat to the point at which the maximum allowable temperature of the unit is exceeded. Also, surging can cause damage to the thrust bearing due to the rotor shifting back and forth from the active to the inactive side. This is defined as the surge cycle of the compressor.

Therefore, techniques have been developed to control surge. See for example, Japanese Patent Publication No. 5-263796.

SUMMARY

In a conventional centrifugal compressor, when surge is predicted by the above technique or any other known technique, a compressor controller can control various parts to control surge. For example, the inlet guide vane and/or the discharge diffuser vane can be controlled or the speed of the compressor can be increased to control surge. While these techniques work relatively well, these systems can require additional components, and thus, increased costs. In addition, these techniques can reduce performance of the compressor.

Therefore, one object of the present invention is to provide a centrifugal compressor that controls surge without reducing performance.

Another object of the present invention is to provide a centrifugal compressor that controls surge without overly complicated construction and/or additional parts.

One or more of the above objects can basically be attained by providing a centrifugal compressor adapted to be used in a chiller, the centrifugal compressor including: a casing having an inlet portion and an outlet portion; an inlet guide vane disposed in the inlet portion; an impeller disposed downstream of the inlet guide vane, the impeller being rotatable about a rotation axis defining an axial direction, and the impeller being adjustably mounted within the casing along the axial direction between at least a first flow rate position and a second flow rate position; a motor arranged and configured to rotate the impeller; and a diffuser disposed in the outlet portion downstream from the impeller with a discharge port of the outlet portion being disposed between the impeller and the diffuser.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENT(S)

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
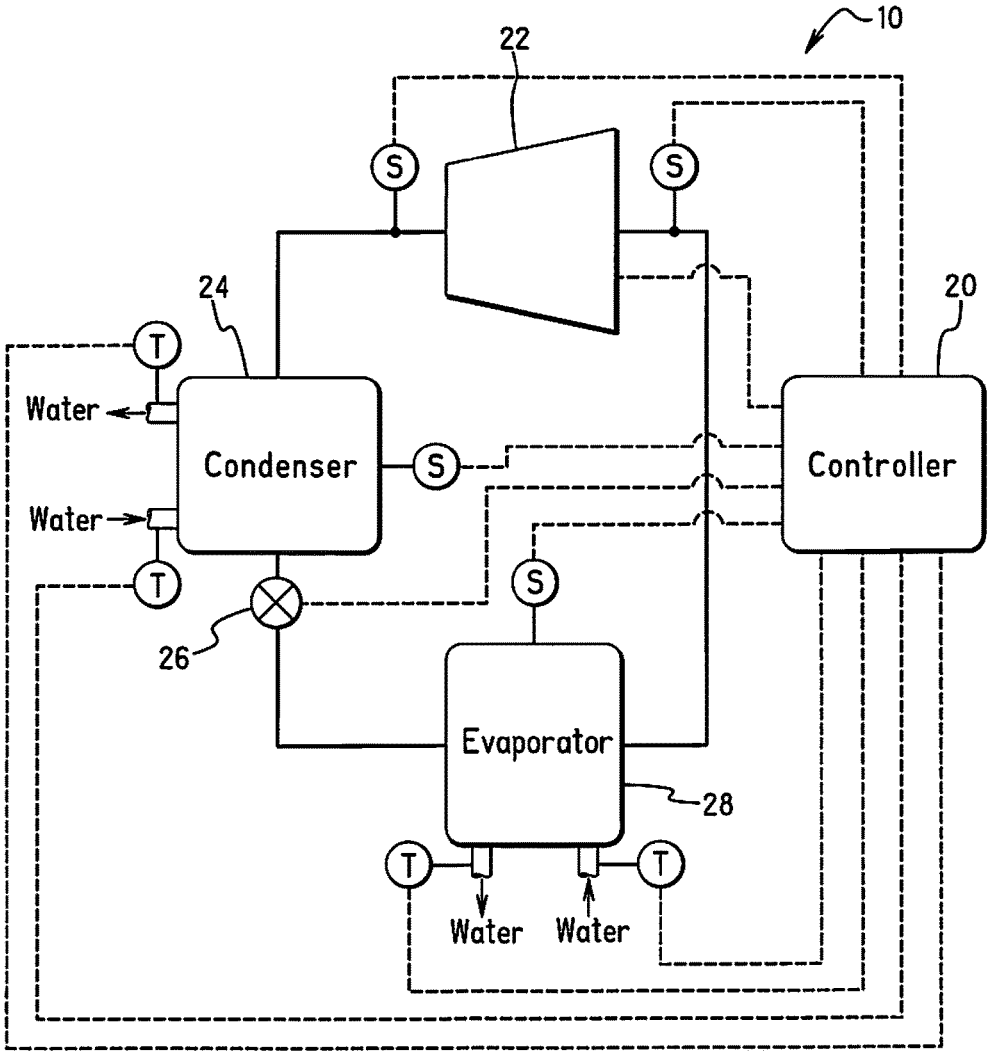
FIG. 1 illustrates a chiller in accordance with an embodiment of the present invention.

Referring initially to FIG. 1, a chiller system 10 is illustrated in accordance with an embodiment of the present invention. The chiller system 10 is preferably a water cooled chiller that utilizes cooling water and chiller water in a conventional manner. The chiller system 10 illustrated herein is a single stage chiller system. However, it will be apparent to those skilled in the art from this disclosure that the chiller system 10 could be a multiple stage chiller system. The chiller system 10 basically includes a controller 20, a compressor 22, a condenser 24, an expansion valve 26, and an evaporator 28 connected together in series to form a loop refrigeration cycle. In addition, various sensors S and T are disposed throughout the circuit as shown in FIG. 1. The chiller system 10 is conventional except that the chiller system controls surge in accordance with the present invention.

Figure 2:
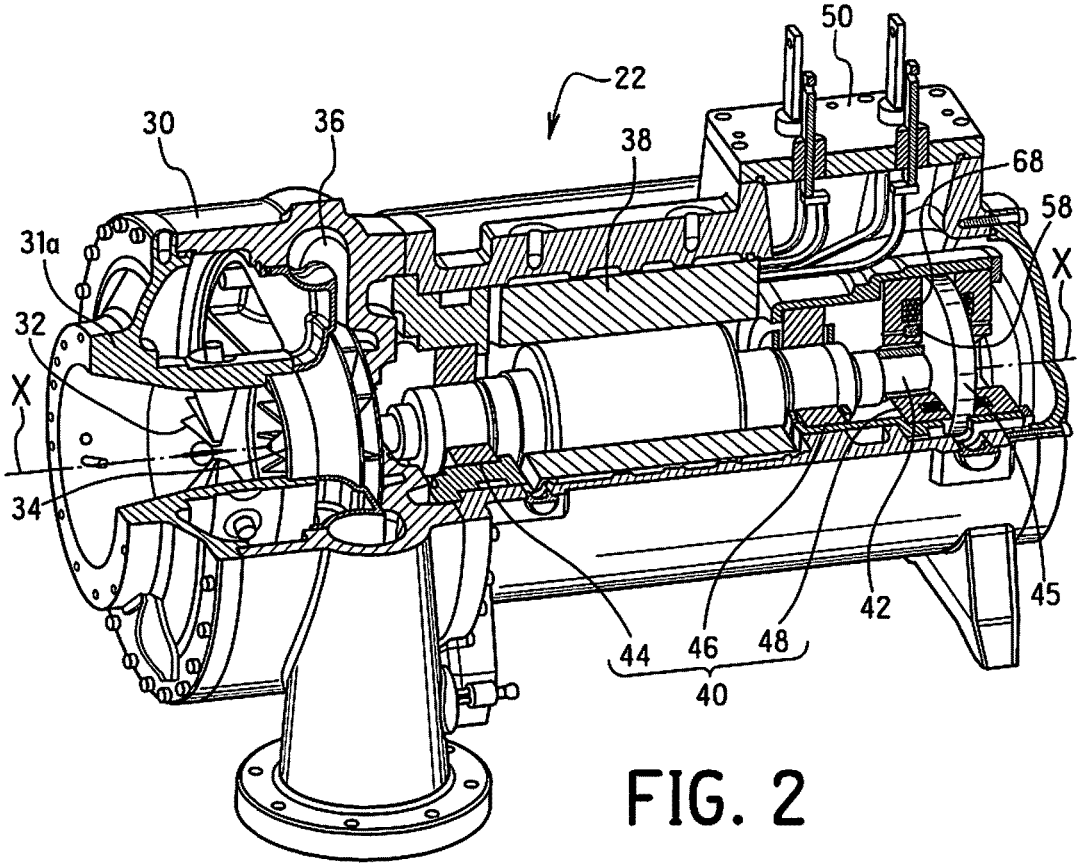
FIG. 2 is a perspective view of the centrifugal compressor of the chiller illustrated in FIG. 1, with portions broken away and shown in cross-section for the purpose of illustration.
Figure 3:
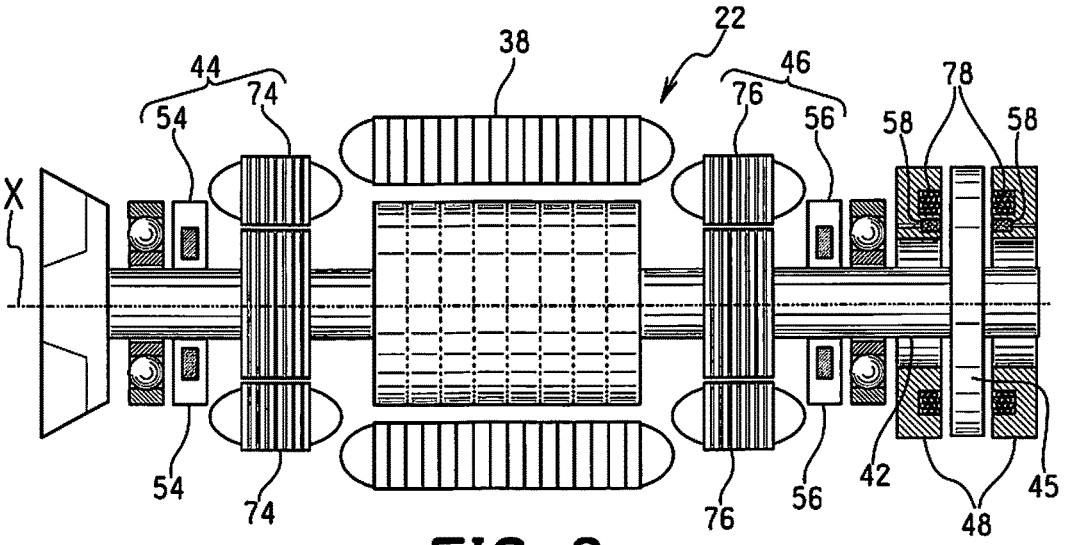
FIG. 3 is a longitudinal cross-sectional view of the impeller, motor and magnetic bearing of the centrifugal compressor illustrated in FIG. 2.

Referring to FIGS. 1-3, in the illustrated embodiment, the compressor 22 is a centrifugal compressor. The centrifugal compressor 22 of the illustrated embodiment basically includes a casing, 30, an inlet guide vane 32, an impeller 34, a diffuser 36, a motor 38 and a magnetic bearing assembly 40 as well as various conventional sensors (only some shown). The controller 20 receives signals from the various sensors and controls the inlet guide vane 32, the motor 38 and the magnetic bearing assembly 40 in a conventional manner, as explained in more detail below. Refrigerant flows in order through the inlet guide vane 32, the impeller 34 and the diffuser 36. The inlet guide vane 32 controls the flow rate of refrigerant gas into the impeller 34 in a conventional manner. The impeller 34 increases the velocity of refrigerant gas, generally without changing pressure. The motor speed determines the amount of increase of the velocity of refrigerant gas. The diffuser 36 increases the refrigerant pressure without changing the velocity. The motor 38 rotates the impeller 34 via a shaft 42. The magnetic bearing assembly 40 magnetically supports the shaft 42. In this manner, the refrigerant is compressed in the centrifugal compressor 22.

In the illustrated embodiment, the chiller system 10 predicts surge in a conventional manner. See for example U.S. Pat. No. 5,095,714. However, when surge is predicted, the chiller system 10 controls surge in accordance with the present invention. In particular, the controller 20 controls the current sent to the magnetic bearing assembly 40 to control an axial position of the impeller 34, as explained in more detail below.

Referring to FIGS. 2-3, the magnetic bearing assembly 40 is conventional, and thus, will not be discussed and/or illustrated in detail herein, except as related to the present invention. Rather, it will be apparent to those skilled in the art that any suitable magnetic bearing can be used without departing from the present invention. As seen in FIG. 2, the magnetic bearing assembly 40 preferably includes a first radial magnetic bearing 44, a second radial magnetic bearing 46 and an axial (thrust) magnetic bearing 48. In any case, at least one radial magnetic bearing 44 or 46 rotatably supports the shaft 42. The thrust magnetic bearing 48 supports the shaft 42 along a rotational axis X by acting on a thrust disk 45. The thrust magnetic bearing 48 includes the thrust disk 45 which is attached to the shaft 42. The thrust disk 45 extends radially from the shaft 42 in a direction perpendicular to the rotational axis X, and is fixed relative to the shaft 42. A position of the shaft 42 along rotational axis X (an axial position) is controlled by an axial position of the thrust disk 45 in accordance with the present invention. The first and second radial magnetic bearings 44 and 46 are disposed on opposite axial ends of the motor 38, or can be disposed on the same axial end with respect to the motor 38 (not illustrated). Various sensors, discussed in more detail below, sense radial and axial positions of the shaft 42 relative to the magnetic bearings 44, 46 and 48, and send signals to the magnetic bearing control section 61 in a conventional manner. The magnetic bearing control section 61 then controls the electrical current sent to the magnetic bearings 44, 46 and 48 in a conventional manner to maintain the shaft 42 in the correct position. Since the operation of magnetic bearings and magnetic bearing assemblies such as magnetic bearings 44, 46 and 48 of magnetic bearing assembly 40 are well known in the art, the magnetic bearing assembly 40 will not be explained and/or illustrated in detail herein, except as related to controlling surge in accordance with the present invention.

The magnetic bearing assembly 40 is preferably a combination of active magnetic bearings 44, 46, and 48, which utilizes non-contact position sensors 54, 56 and 58 to monitor shaft position and send signals indicative of shaft position to the magnetic bearing control section 61. Thus, each of the magnetic bearings 44, 46 and 48 are preferably active magnetic bearings. A magnetic bearing control section 61 uses this information to adjust the required current to a magnetic actuator to maintain proper rotor position both radially and axially. Active magnetic bearings are well known in the art, and thus, will not be explained and/or illustrated in detail herein, except as related to controlling surge in accordance with the present invention.

Figure 11:
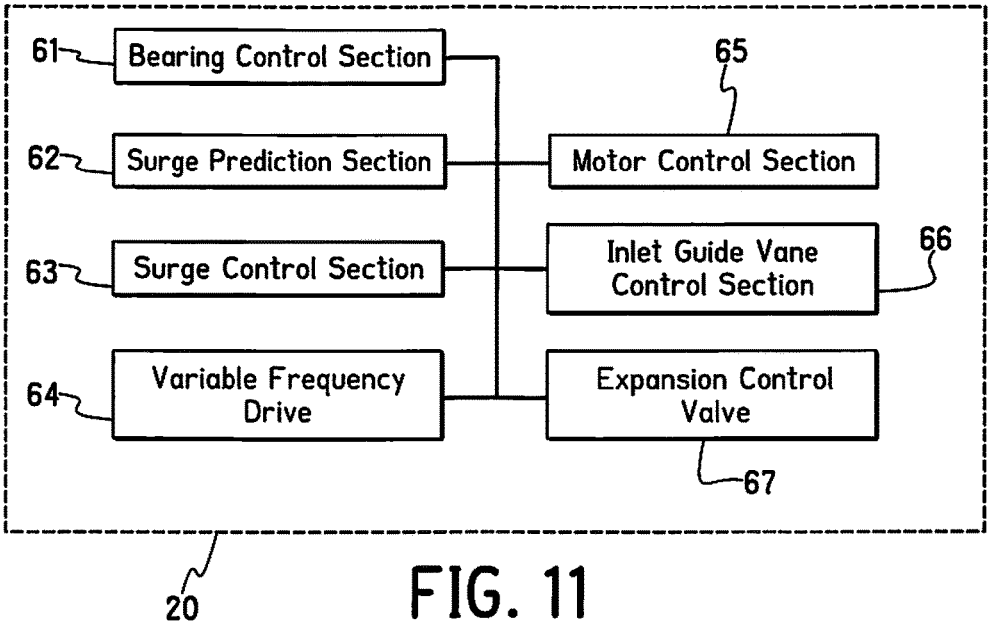
FIG. 11 is a schematic diagram of the chiller controller of the chiller system of FIGS. 1 and 2.

Referring to FIGS. 1, 2, and 11, the controller 20 includes a magnetic bearing control section 61, a surge prediction section 62, a surge control section 63, a variable frequency drive 64, a motor control section 65, an inlet guide vane control section 66, and an expansion valve control section 67. The magnetic bearing control section 61, the surge prediction section 62, the surge control section 63, the variable frequency drive 64, the motor control section 65 and the inlet guide vane control section 66 form parts of a centrifugal compressor control portion that is electrically coupled to an I/O interface 50 of the compressor 22.

Because the magnetic bearing control section 61 is connected to several portions of the magnetic bearing assembly 40 and communicates with various sections of the controller 20, the various sections of the controller 20 can receive signals from the sensors 54, 56 and 58 of the compressor 22, perform calculations and transmit control signals to parts of the compressor 22 such as the magnetic bearing assembly 40. Similarly, the various sections of the controller 20 can receive signals from the sensors S and T, perform calculations and transmit control signals to the compressor 22 (e.g., the motor) and the expansion valve 26. The control sections and the variable frequency drive 64 can be separate controllers or can be mere sections of the chiller controller programmed to execute the control of the parts described herein. In other words, it will be apparent to those skilled in the art from this disclosure that the precise number, location and/or structure of the control sections, control portion and/or controller 20 can be changed without departing from the present invention so long as the one or more controllers are programed to execute control of the parts of the chiller system 10 as explained herein.

The controller 20 is conventional, and thus, includes at least one microprocessor or CPU, an Input/output (I/O) interface, Random Access Memory (RAM), Read Only Memory (ROM), a storage device (either temporary or permanent) forming a computer readable medium programmed to execute one or more control programs to control the chiller system 10. The controller 20 may optionally include an input interface such as a keypad to receive inputs from a user and a display device used to display various parameters to a user. The parts and programming are conventional, except as related to controlling surge, and thus, will not be discussed in detail herein, except as needed to understand the embodiment(s).

The magnetic bearing control section 61 normally receives signals from the sensors 54, 56 and 58 of the magnetic bearing assembly 40, and transmits electrical signals to the magnetic bearings 44, 46 and 48 to maintain the shaft 42 in the desired position in a conventional manner. More specifically, the magnetic bearing control section 61 is programmed to execute a magnetic bearing control program to maintain the shaft 42 in the desired position in a conventional manner during normal operation when surge is not predicted. However, if surge is predicted, the axial position of the shaft 42 can be adjusted using the surge control section 62 and the axial magnetic bearing 48. Thus, the axial position of the impeller 34, which is fixed to the shaft 42, can be adjusted relative to the diffuser 36, as explained in more detail below.

The variable frequency drive 64 and motor control section 65 receive signals from at least one motor sensor (not shown) and control the rotation speed of the motor 38 to control the capacity of the compressor 22 in a conventional manner. More specifically, the variable frequency drive 64 and motor control section 65 are programmed to execute one or more motor control programs to control the rotation speed of the motor 38 to control the capacity of the compressor 22 in a conventional manner. The inlet guide vane control section 66 receives signals from at least one inlet guide vane sensor (not shown) and controls the position of the inlet guide vane 32 to control the capacity of the compressor 22 in a conventional manner. More specifically, the inlet guide vane control section 66 is programmed to execute an inlet guide vane control program to control the position of the inlet guide vane 32 to control the capacity of the compressor 22 in a conventional manner. The expansion valve control section 67 controls the opening degree of the expansion valve 26 to control the capacity of the chiller system 10 in a conventional manner. More specifically, the expansion valve control section 67 is programmed to execute an expansion valve control program to control the opening degree of the expansion valve 26 to control the capacity of the chiller system 10 in a conventional manner. The motor control section 65 and the inlet guide vane control section 66 work together and with the expansion valve control section 67 to control the overall capacity of the chiller system 10 in a conventional manner. The controller 20 receives signals from the sensors S and optionally T to control the overall capacity in a conventional manner. The optional sensors T are temperature sensors. The sensors S are preferably conventional pressure sensors and/or temperature sensors used in a conventional manner to perform the control.

Each the magnetic bearing 44 includes a plurality of actuators 74 and at least one amp 84. Similarly, each the magnetic bearing 46 includes a plurality of actuators 76 and at least one amplifier 86. Likewise, Each the magnetic bearing 48 includes a plurality of actuators 78 and at least one amp 88. The amplifiers 84, 86 and 88 of each magnetic bearing 44, 46, and 48 may be a multi-channel amp to control the number actuators thereof, or can include separate amplifiers for each actuator 74, 76 and 78. In either case, the amplifiers 84, 86 and 88 are electrically connected to the actuators 74, 76 and 78 of each respective magnetic bearing 44, 46, and 48.

Figure 12:
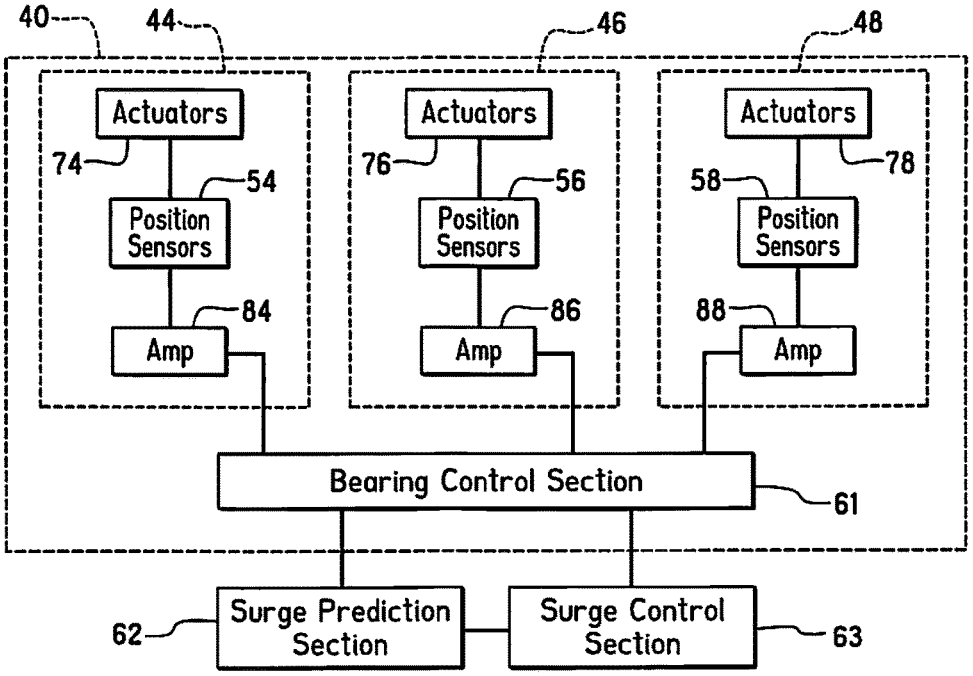
FIG. 12 is a schematic diagram illustrating the relationship between the magnetic bearing assembly, magnetic bearing control section 61, surge prediction section 62, and the surge control section 63 of the chiller system of FIGS. 1 and 2.

Referring to FIGS. 11 and 12, the magnetic bearing control section 61 is electrically connected to the surge control section 63, and receives signals from the surge control section 63. The magnetic bearing control section 61 can adjust the desired axial position of the shaft 42 to be any point within a shiftable range of the magnetic bearing 48. The magnetic bearing control section 61 is programed to adjust the electrical signal to the amplifier 88 of the magnetic bearing 48 to adjust the axial position of the shaft 42. The magnetic bearing 48 may include an amplifier 88 with two channels to independently control each actuator 78 of the magnetic bearing 48 respectively, or each actuator 78 of the magnetic bearing 48 may have a unique corresponding amplifier 88. The actuators 78 of the magnetic bearing 48 act on the thrust disk 45 by exerting a magnetic force. The actuators 78 of the magnetic bearing 48 generate a magnetic force which is based upon an electrical current. Thus, the magnetic force can be variably controlled by controlling the amount of current supplied to each actuator 78, as will be explained in further detail below.

Figure 5:
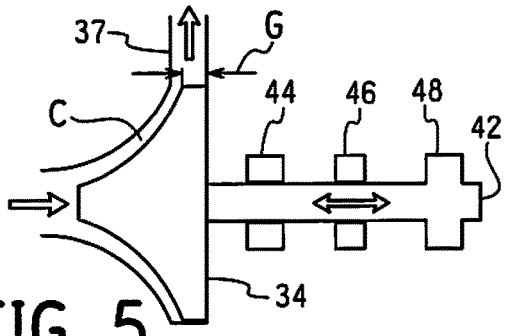
FIG. 5 is a diagrammatic longitudinal view of part of the bearing, the impeller, casing and diffuser inlet of the centrifugal compressor illustrated in FIGS. 1-4, with the impeller in an axial position fully opening (100%) the diffuser inlet.
Figure 6:
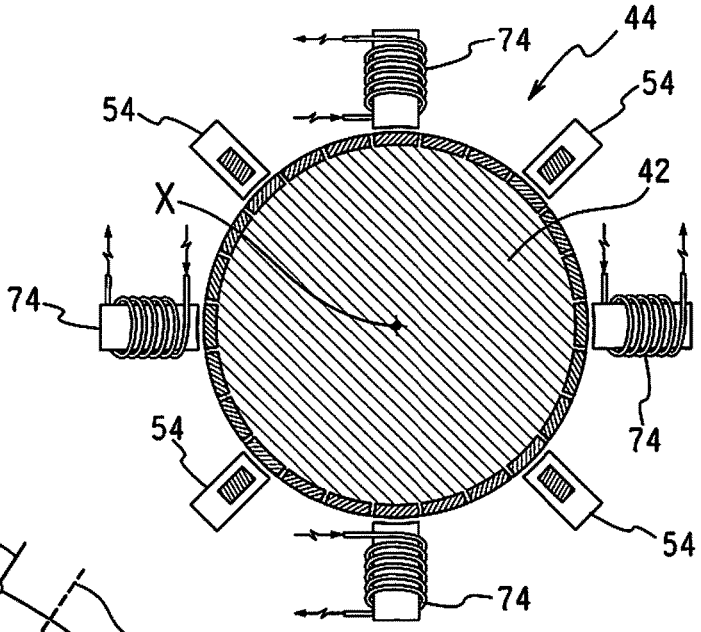
FIG. 6 is an axial view of the shaft of the rotational magnetic bearing illustrating a location of a radial magnetic bearing.

In the illustrated embodiment, the magnetic bearing 48 includes the thrust disk 45, two actuators 78 disposed on opposite sides of the thrust disk 45, two position sensors 58 disposed on opposite sides of the thrust disk 45, an amplifier 88 electrically connected to the two actuators 78, and the magnetic bearing control section 61. The magnetic bearing control section 61 is electrically connected to the amplifier 88, the position sensors 58, and the other portions of the controller 20. Each actuator 78 receives a respective current from the amplifier 88, and each current being determined by the magnetic bearing control section 61 and communicated to the amplifier 88 by a signal. The actuators 78 of the magnetic bearing 48 bias the thrust disk 45 to an axial position in which the net force of the two actuators 78 reach an equilibrium. During normal operation, the shaft 42 will be disposed at an axial position in which the flow rate is 100% as illustrated in FIG. 5.

The magnetic bearing control section 61 of the present invention differs from a conventional magnetic bearing controller in that it is arranged to receive at least one external signal. The at least one external signal is an adjustment signal which indicates an adjustment to the desired axial position, which is needed in response to surge being predicted. The magnetic bearing control section 61 is programed to receive the adjustment signal and adjust the signal output to the amplifier 88 of the magnetic bearing 48 that indicates the amount of current to be supplied to the actuators 78 of magnetic bearing 48. In other words, the magnetic bearing control section 61 of the present invention will adjust the position of the shaft 42 in the axial direction based on an adjustment signal received.

Figure 4:
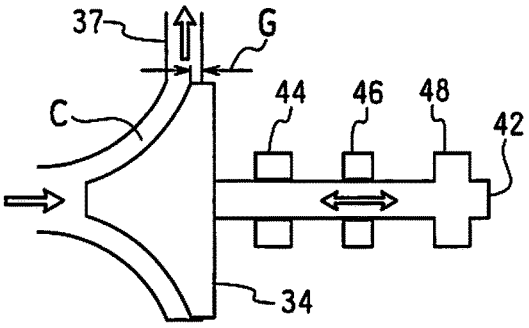
FIG. 4 is a diagrammatic longitudinal view of part of the bearing, the impeller, casing and diffuser inlet of the centrifugal compressor illustrated in FIGS. 1-3, with the impeller in an axial position partially opening (<100%) the diffuser inlet.

The axial position of the impeller 34 relative to the inlet will determine the flow rate of the refrigerant and the velocity of the flow of refrigerant out of the impeller 34 when all other aspects of the chiller 10 remain constant. The flow rate of the refrigerant will also affect the capacity of the compressor 22. Because shaft 42 is shiftable to any point within the shiftable range of magnetic bearing 48, and the impeller 34 is attached to the shaft 42, the impeller 34 is also shiftable to an infinite number of positions in the axial direction. Each axial position of the impeller results in a unique flow rate and unique velocity. Thus, the flow rate and velocity of the refrigerant from the impeller 34 of the compressor may be infinitely adjusted. FIG. 4 illustrates an axial position of the impeller 34 in which the flow rate is less than 100%, which may be any point within the shiftable range that is not the closest to the diffuser 36 (shown in FIG. 5). FIG. 5 illustrates an axial position of the impeller 34 in which the flow rate is 100% and the impeller 34 is disposed at the point of the shiftable range closest to diffuser 36.

The surge control section 63 is programmed to control surge upon receiving a signal from the surge prediction section 62. The signal from the surge prediction section 62 indicates that surge is predicted to occur. The surge prediction section 62 may predict surge in a conventional manner, such as those set forth in U.S. Pat. No. 5,095,714, or using any other technique without departing from the scope of this invention, as would be apparent in light of this disclosure. However, in the illustrated embodiment, the surge control section 63 controls surge by adjusting the axial position of the impeller 34 (moving the impeller toward the right in the views shown herein), i.e., from the 100% flow rate position shown in FIG. 5 toward a less open <100% flow rate position (only one shown in FIG. 4). If the full axial position adjustment of the impeller 34 is insufficient to eliminate surge being predicted by the surge prediction section 62, optionally other conventional techniques, such as increasing rotation speed of the motor 38 and/or adjusting the inlet guide vane, can be used in addition to the technique discussed and illustrated herein. However, by using the surge control achieved from axial position adjustment of the impeller 34 disclosed herein, one or more conventional surge control techniques can be avoided and/or eliminated. For example surge control using a diffuser vane could be eliminated.

The surge control section 63 is electrically connected to the bearing control section 61. The surge control section 63 sends an adjustment signal to the magnetic bearing control section 61 to control surge. More specifically, the surge control section 63 controls surge by shifting the shaft 42 in the axial direction. More specifically, the surge control section 63 is programmed to output an adjustment signal indicating an adjustment to the axial position of the impeller 34. The adjustment corresponds to a portion of the adjustable range. For example, each adjustment can be 5%, 10%, or 15% of the adjustable range. Thus, the surge control section 63 is programed to control surge by adjusting the flow rate of the compressor 22 which occurs when the impeller 34 is shifted in increments.

The surge control section 63 is programmed to adjust the axial position of the impeller 34 from a normal operating position (illustrated in FIG. 5) to numerous adjusted positions (only one illustrated in FIG. 4). Incremental adjustment as mentioned above is merely one example of how the axial position of the impeller may be adjusted in accordance with this disclosure. Alternatively, the adjustment signal may indicate a single amount of adjustment to be sent from the surge control section 63 to the magnetic bearing control section 61 based on a determination of how much of a shift must be made to control the predicted surge as calculated by the surge control section 63, or based on predetermined values such as a map as will be further explained in detail below.

The surge control section 63 is programmed to determine the amount of adjustment of the position of impeller 34. The surge control section 63 is programmed to determine the amount of adjustment based on at least one operating parameter of the compressor 22. More specifically, the surge control section 63 is programmed to determine a target flow rate based on the predicted surge, as would be apparent in light of this disclosure. For example, the target flow rate may be determined based on at least one of the pressure of the refrigerant at the inlet of the impeller 34 and the pressure of the refrigerant within the diffuser. Once the surge control section 63 has determined the target flow rate, the surge control section 63 then calculates an adjustment to the axial position of the impeller 34 that would result in the target flow rate. The surge control section 63 then sends an adjustment signal to the magnetic bearing control section 61 indicating the adjustment to the axial position of the impeller 34. By non-limiting example, surge may be controlled by increasing velocity of the coolant. Increasing velocity of the coolant expands the operation range. Thus, the surge control section 63 may generate an adjustment signal corresponding to a portion of the adjustable range. For Example, each adjustment resulting from the adjustment signal can be 5%, 10%, or 15% of the adjustable range.

In response to the adjustment signal, the magnetic bearing control section 61 shifts the impeller in the axial direction from the normal operating position to the adjusted position. The normal operation position has a first flow rate, and an adjusted position has a second flow rate. By non-limiting example, the first flow rate is a peak flow rate (100%) of the compressor 22 as illustrated in FIG. 5, while the second flow rate is less than the peak flow rate of the compressor 22 as illustrated in FIG. 4. The adjustment signal may also depend on different flow rates as determined based upon the method of controlling surge to which the surge control section 63 is programmed to execute. It would be apparent to one of ordinary skill in the art, in light of this disclosure, that various methods of calculating the amount of adjustment necessary based on a prediction of surge may be used.

Referring to FIGS. 4 and 5, the flow rate will affect the velocity of the coolant exiting the impeller 34. In a normal operating position of the impeller 34, the clearance C is small, and the gap G from which coolant exits the impeller is large. In FIGS. 4-5, the clearance and the structure of the compressor are greatly simplified for the sake of understanding. In this normal arrangement (FIG. 5), the flow rate of the coolant exiting the impeller 32 is normal, and the velocity is normal. After the impeller 34 is shifted in response to a prediction that surge will occur, as illustrated in FIG. 4, the gap G is smaller, relative to the normal operating position. In the adjusted arrangement, the flow rate of the coolant exiting the impeller 32 is less than the flow rate of the coolant in the normal arrangement, and the velocity of the coolant is greater than the velocity of the coolant in the normal arrangement. The clearance C also grows, but as understood from FIG. 2, the clearance C will not have an impact on the flow rate or velocity of coolant leaving the impeller 34 because the clearance C is preferable seal from the inlet guide vane supplying coolant to the impeller. The differences in flow rate and velocity of the coolant are a result of the gap G narrowing in the adjusted arrangement. Generally, the changes to clearance C do not interfere with the changes to the flow rate and velocity of the coolant, as would be understood in light of this disclosure and as mentioned above.

The second flow rate and second velocity (the adjusted position of the impeller 34) may be determined according to several techniques. In one embodiment, the surge control section 63 may incrementally adjust the flow rate. For example, if the surge control section 63 receives a signal from the surge prediction section 62, the surge control section may adjust the flow rate by 5% by adjusting the position of the impeller 34. Should the surge prediction section 62 predict surge after the surge control section 63 has adjusted the flow rate by 5%, the surge control section 63 would adjust the flow rate by 10% by adjusting the position of the impeller 34. This cycle of incrementally adjusting the flow rate would continue until no surge is predicted by the surge prediction section 62, or the surge control section 63 has reached a maximum amount of adjustment.

Alternatively, the second flow rate and second velocity (the adjusted position of the impeller 34) may be determined by the surge control section 63 based on a predicted amount of surge. In other words, if surge prediction section 62 predicts a surge of amount X, the surge control section 63 may be programmed to determine an adjustment amount to account for a surge of amount X. Based on the adjustment amount to account for a surge of amount X, the surge control section can generate an adjustment signal based on the amount of adjustment, and adjust the position of the impeller 34.

Moreover, the second flow rate and second velocity (the adjusted position of the impeller 34) may be determined by the surge control section 63 based on a predetermined amount. For example, the amount of adjustment may be a static value, or based on a predetermined map. The surge control section 63 may default to a predetermined static adjustment amount during each instance the surge control section 63 receives a signal predicting surge and adjust the position of the impeller 34 to a predetermined position. Alternatively, the surge control section 63 may determine the amount of adjustment based on a predetermined map. The predetermined map may indicate an adjustment amount respective to a time or a duration which the surge prediction section 63 has predicted surge, and adjust the position of the impeller 34 to a position determined based on the predetermined map. Such a predetermined map is usually generated from experiments and programmed into the controller 20.

Conventionally, the inlet guide vane control section 66 controls the flow rate of refrigerant gas into the impeller by controlling the inlet guide vane 32. For example, the guide vane control section may determine a target capacity of the system, determine the amount of adjustment to the guide vane 32 necessary to reach the target capacity, and control the guide vane 32 to achieve the target capacity to control surge. However, an adjustable guide vane 32 increases the complexity of a conventional chiller system, and are a point of failure for conventional chiller systems so equipped. Likewise, some centrifugal compressors utilize an adjustable diffuser vane, which can be eliminated.

By controlling surge using the techniques described herein, the chiller system 10 is no longer limited to controlling surge via the inlet guide vane/guide vane control section, and/or an adjustable diffuser guide vane. In addition other adjustment structures may possibly be eliminated or made unnecessary. In other words, the diffuser may have no diffuser vanes (adjustable diffuser vanes) (not illustrated). Alternatively, the inlet guide vane may be fixed, and not adjustable (not illustrated). By foregoing the guide vane 32, the reliability of chiller system 10 may be increased, and the cost may be decreased.

Figure 7:
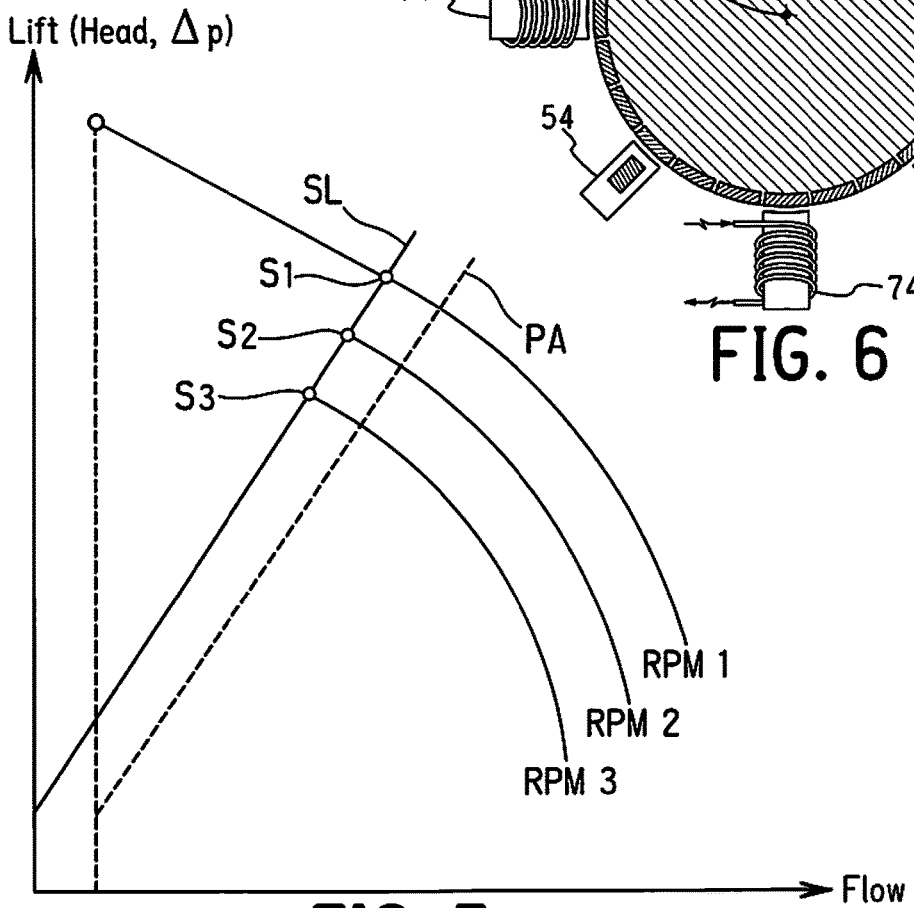
FIG. 7 is graph illustrating head as compared to flow rate for three different rpm of the centrifugal compressor, with a surge line illustrated.
Figure 8:
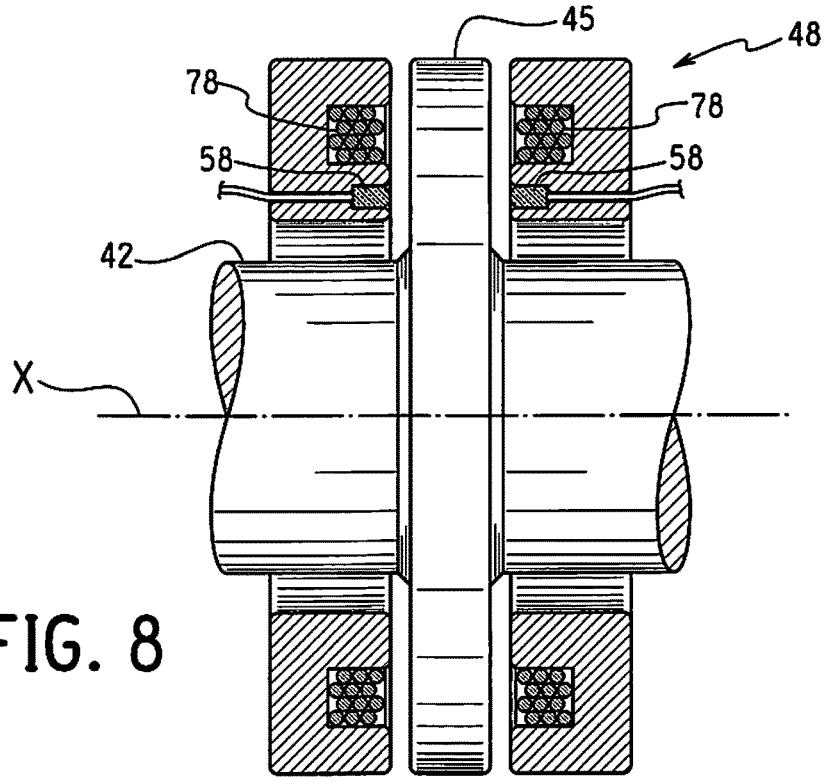
FIG. 8 is a partial cross-sectional plan view of the magnetic thrust bearing of FIGS. 2 and 3.
Figure 9:
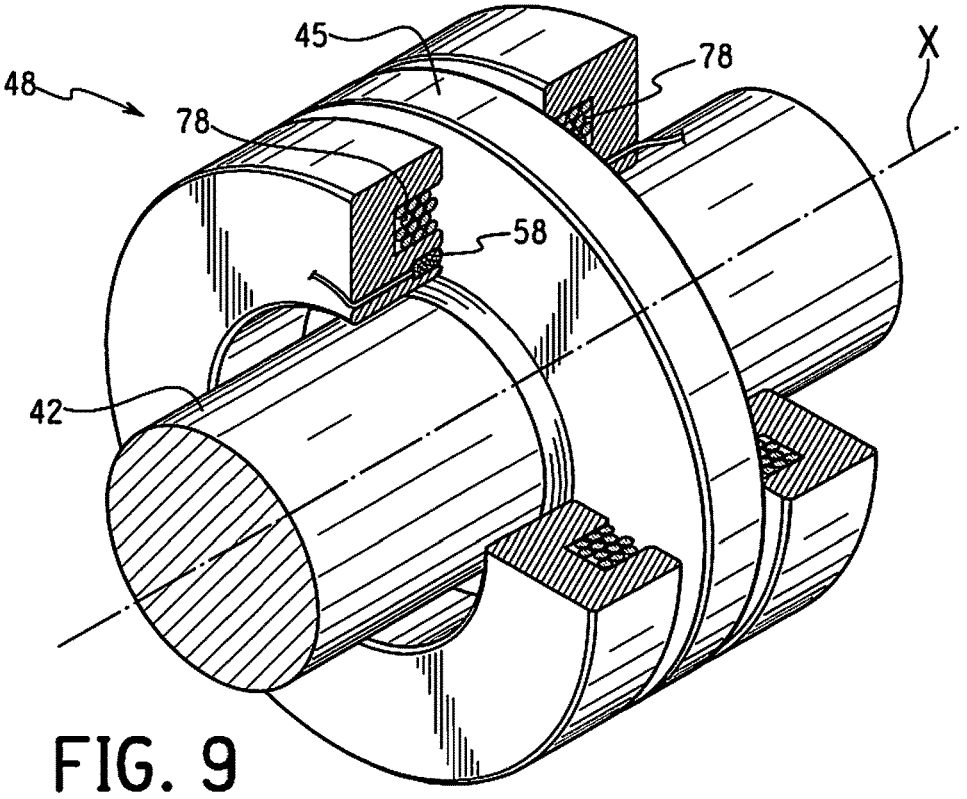
FIG. 9 is a cutout perspective view of the magnetic thrust bearing of FIGS. 2, 3, and 8.
Figure 10:
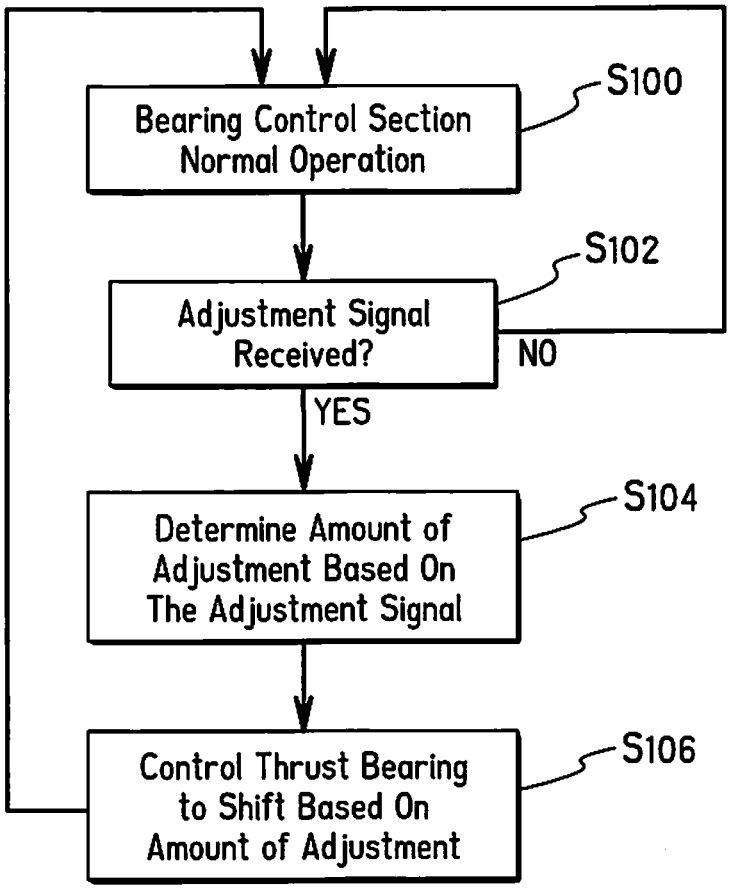
FIG. 10 is a flow chart illustrating a method of increasing operating capacity to control surge.

Referring to FIG. 7, surge is the complete breakdown of steady flow in the compressor, which typically occurs at a low flow rate. FIG. 7 illustrates a surge line SL, which connects the surge points S1, S2, and S3 at rpm1, rpm2, and rpm3, respectively. These points are the peak points in which pressure generated by the compressor is less than the pipe pressure downstream of the compressor. These points illustrate initiation of the surge cycle. Broken line PA illustrates a surge control line. The distance between line PA and SL show the inefficiency of surge control methods. By reducing the difference between a surge control line PA and surge line SL, the compressor 22 can be controlled to be more efficient. One advantage of the aforementioned surge control methods is that it provides a novel methods of controlling surge; thus the surge control line PA may be closer to surge line SL when compared to previous methods.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A centrifugal compressor adapted to be used in a chiller, the centrifugal compressor comprising:

a casing having an inlet portion and an outlet portion;

an inlet guide vane disposed in the inlet portion;

an impeller disposed downstream of the inlet guide vane, the impeller being rotatable about a rotation axis defining an axial direction, the impeller being a closed-face impeller that is closed between a radially inward portion of the impeller that faces the inlet guide vane and through which a fluid enters the impeller and a radially outward edge of the impeller from which the fluid exits the impeller, and the impeller being adjustably mounted within the casing along the axial direction between at least a first flow rate position and a second flow rate position, one of the first and second flow rate positions being a 100% flow rate position and the other of the first and second flow rate positions being a <100% flow rate position that is less open than the 100% flow rate position;

a motor arranged and configured to rotate the impeller; and a diffuser disposed in the outlet portion downstream from the impeller with an outlet port of the outlet portion being disposed between the impeller and the diffuser, the radially outward edge of the impeller axially overlapping less of the outlet port in the <100% flow rate position than in the 100% flow rate position.

2. The centrifugal compressor according to claim 1, further comprising an impeller axial position control mechanism configured to control adjustment of the impeller between at least the first and second flow rate positions.

3. The centrifugal compressor according to claim 2, wherein the impeller is attached to a shaft arranged and configured to be rotated by the motor, the impeller axial position control mechanism includes a thrust bearing attached to the shaft, and the thrust bearing is adjustably mounted within the casing to move the impeller between at least the first and second flow rate positions.

4. The centrifugal compressor according to claim 3, wherein the thrust bearing is a magnetic thrust bearing adjustable by adjusting current flow to the magnetic thrust bearing.

5. The centrifugal compressor according to claim 4, wherein the shaft is rotatably supported by a radial magnetic bearing.

6. The centrifugal compressor according to claim 4, wherein the impeller axial position control mechanism further includes a controller programmed to control adjustment of the thrust magnetic bearing based on at least one operating parameter of the centrifugal compressor.

7. The centrifugal compressor according to claim 6, wherein the at least one operating parameter of the centrifugal compressor includes at least one pressure at an inlet of the impeller and pressure within the diffuser.

8. The centrifugal compressor according to claim 7, wherein the at least one operating parameter of the centrifugal compressor includes a difference between pressure at an inlet of the impeller and pressure within the diffuser.

9. The centrifugal compressor according to claim 1, wherein the impeller is adjustably mounted within the casing along the axial direction between an infinite number of flow rate positions.

10. The centrifugal compressor according to claim 1, wherein the diffuser does not include diffuser vanes.

11. The centrifugal compressor according to claim 1, wherein the diffuser does not include adjustable guide vanes.

12. The centrifugal compressor according to claim 1, wherein the inlet guide vane is not adjustable.

* * * * *